US009580995B2

(12) United States Patent
Kanstad

(10) Patent No.: US 9,580,995 B2
(45) Date of Patent: Feb. 28, 2017

(54) CONTROLLED PRESSURE EQUALIZATION

(71) Applicant: ONESUBSEA IP UK LIMITED, London (GB)

(72) Inventor: Stig Kaare Kanstad, Bergen (NO)

(73) Assignee: OneSubsea IP UK Limited, London (GB)

( * ) Notice: Subject to any disclaimer, the term of this patent is extended or adjusted under 35 U.S.C. 154(b) by 196 days.

(21) Appl. No.: 14/243,280

(22) Filed: Apr. 2, 2014

(65) Prior Publication Data

US 2015/0285035 A1 Oct. 8, 2015

(51) Int. Cl.

| | |
|---|---|
| ***E21B 41/00*** | (2006.01) |
| ***F04B 23/02*** | (2006.01) |
| ***F04B 47/02*** | (2006.01) |
| ***F04B 49/00*** | (2006.01) |

(52) U.S. Cl.

CPC ..... *E21B 41/0007* (2013.01); *F04B 23/02* (2013.01); *F04B 47/02* (2013.01); *F04B 49/00* (2013.01); *Y10T 137/0396* (2015.04); *Y10T 137/264* (2015.04); *Y10T 137/2605* (2015.04)

(58) Field of Classification Search

CPC ..... E21B 41/0007; F04B 23/02; F04B 47/02; F04B 49/00; Y10T 137/0396; Y10T 137/2605; Y10T 137/264

USPC ..... 137/236.1

See application file for complete search history.

(56) References Cited

U.S. PATENT DOCUMENTS

| | | | | |
|---|---|---|---|---|
| 8,156,953 | B2 * | 4/2012 | Tveita | G05D 16/2033 137/102 |
| 2011/0315249 | A1 | 12/2011 | Kanstad et al. | |
| 2014/0290753 | A1 * | 10/2014 | Grimstad et al. | G05D 16/2033 137/14 |

FOREIGN PATENT DOCUMENTS

| | | | |
|---|---|---|---|
| WO | 2010080037 | A1 | 7/2010 |

* cited by examiner

*Primary Examiner* — Kevin Lee

(74) *Attorney, Agent, or Firm* — Conley Rose, P.C.

(57) ABSTRACT

Systems and methods for controlled equalization of fluid pressure are described. The system can include a flow restricting nozzle in line with an accumulator which together provide a gradual, controlled equalization of pressure between two locations. For example, in the subsea environment, the pressures can vary between a subsea processing station and a subsea flow line. The systems can be configured as ROV retrievable, or they can be integrated into the subsea processing station. In some cases, more than one accumulator and/or more than one flow restricting nozzles can be used in the system to provide for versatility and robustness.

15 Claims, 6 Drawing Sheets

CONTROLLED PRESSURE EQUALIZATION

FIELD

The present disclosure relates generally to techniques for equalizing pressure. More particularly, the present disclosure relates to systems and methods for controlled equalization of fluid pressure in subsea equipment.

BACKGROUND

FIG. 2 is a schematic showing a typical subsea station 108 with a bypass header and isolation valves 232 and 234. The pressure inside the subsea station 108 when isolated from the production flow line will in most cases deviate from both the ambient sea pressure and from the pressure in the production flow line. The pressure difference can often be significant, especially at large water depths and high design pressure systems. This pressure difference needs to be equalized in a controlled manner in order to prevent damaging equipment due to rapid pressure changes.

A current method for pressure equalization is to install two or more valves 202 and 204 in series with a small volume between the valves. The pressure can be equalized in small steps by first opening and then closing the valve closest to the high-pressure side. Then opening and closing the valve closest to the low-pressure side. The pressure can in this manner by repeating the process several times be fully equalized between the high- and low-pressure sides.

The above-described method will cause a series of instantaneous pressure changes which magnitude will depend on the size of the volume between the two valves. A valve can usually only be operated a certain number of times before it starts leaking/malfunctioning. Hence, there is also a lifetime limitation regarding how often a valve can be opened and closed before the valve will malfunction. Traditional nozzle designs should not be used to slow down the pressure change due to high velocities, cavitation danger, unknown/uncertain behaviour at low Reynold numbers (transient and laminar zone) etc.

SUMMARY

According to some embodiments, a system is described for controllably decreasing a pressure difference between a higher pressure volume (such as a fluid conducting pipe) and a lower pressure volume (such as a fluid conducting pipe). The system includes: a fluid inlet configured for fluid attachment to the higher pressure fluid conducting pipe; a fluid outlet configured for fluid attachment to the lower pressure fluid conducting pipe; a fluid flow line running from the fluid inlet to the fluid outlet; an accumulator or other pressure storage reservoir in fluid communication with the fluid flow line and configured to store and release fluid from the fluid flow line; and a flow restricting nozzle positioned between the fluid inlet and fluid outlet. According to some embodiments, the pressure storage reservoir is a gas or liquid contained in the higher pressure volume. In the case of a liquid, if close to its boiling point, will start evaporating to gas when the pressure starts dropping, thereby indirectly acting as an accumulator. This effect is due to the evolving gas preventing the pressure from dropping in the same manner as gas expansion from an initially trapped gas volume. According to some embodiments the system is configured for deployment in a subsea location wherein the higher and lower pressure fluid conducting pipes are located that in that subsea location. According to some embodiments, the pressure between the higher and lower pressure fluid conducting pipes is equalized. According to some embodiments, one of the conducting pipes forms part of a subsea processing station and the other is a subsea flow line. The subsea processing station, according to some embodiments, is of one of the following types: multiphase subsea pump; single-phase subsea pump; hybrid subsea pump; subsea multiphase compressor; subsea multiphase meter; subsea multiphase measurement system; subsea sampling system; subsea separation system; or a subsea manifold. According to some embodiments, the accumulator is in fluid communication with the fluid flow line between the nozzle and the fluid inlet.

According to some embodiments, the system further includes: a second accumulator in fluid communication with the fluid flow line and configured to store and release fluid from the fluid flow line; and first and second isolation valves positioned and configured to isolate the accumulator and the second accumulator, respectively, from fluid communication with the fluid flow line. The system can also include one or more additional flow restricting nozzles positioned between the fluid inlet and fluid outlet and each in parallel with the flow restricting nozzle.

According to some embodiments, the system is configured to be retrievable from a subsea location using a remotely operated underwater vehicle. According to some embodiments, the system is housed within and configured to be deployed upon a skid of a remotely operated underwater vehicle. According to some other embodiments, the system is integrated with the subsea station and is configured to be retrieved only along with the subsea station. The capacity of the accumulator and frictional loss characteristics of the nozzle can be selected to provide a desired smoothness in pressure change during operation.

According to some embodiments, a method is described for controllably decreasing a pressure difference between a higher pressure fluid conducting pipe (or other volume) and a lower pressure fluid conducting pipe (or other volume). The method includes: opening a first valve thereby allowing fluid communication along a fluid flow line between the higher pressure fluid conducting pipe and an accumulator such that pressure in the accumulator matches pressure in the higher pressure fluid conducting pipe; and then, opening a second valve thereby allowing fluid communication along the fluid flow line between the lower pressure fluid conducting pipe, a flow restricting nozzle and the accumulator. The combination of the accumulator and the nozzle providing a smooth transition towards equalization of the pressures of the higher and lower pressure fluid conducting pipes. According to some embodiments, the opening of the first valve, which can be connected to a subsea processing station, takes place following a high pressure procedure in the subsea processing station. According to some embodiments, prior to opening the first valve, one or more accumulator selection valves are operated in order to provide fluid communication of the accumulator with the fluid flow line and to isolate a second accumulator from the fluid flow line. According to some embodiments, one or more other flow restricting nozzles are positioned in parallel with the flow restricting nozzle, and prior to opening the second valve, one or more nozzle selection valves are operated so as to select the flow restricting nozzles that will be used in equalizing the pressure. The nozzle selection can be made, for example, to attain a desired smoothness in pressure equalization, and/or reduce detrimental effects due to particulate clogging of nozzles. In some cases, prior to the opening of the first valve, the accumulator can be pre-charged using a source fluid.

These together with other aspects, features, and advantages of the present disclosure, along with the various features of novelty, which characterize the invention, are pointed out with particularity in the claims annexed to and forming a part of this disclosure. The above aspects and advantages are neither exhaustive nor individually or jointly critical to the spirit or practice of the disclosure. Other aspects, features, and advantages of the present disclosure will become readily apparent to those skilled in the art from the following description of exemplary embodiments in combination with the accompanying drawings. Accordingly, the drawings and description are to be regarded as illustrative in nature, and not restrictive.

It should be noted that the term "controllable" here is used to express "to keep control" of the pressure decrease or increase during pressure equalization. That is, the pressure decrease or increase during the equalization should be predictable. Hence, the term "controllable" as used herein does not mean "adjustable".

BRIEF DESCRIPTION OF THE DRAWINGS

To assist those of ordinary skill in the relevant art in making and using the subject matter hereof, reference is made to the appended drawings, in which like reference numerals refer to similar elements.

DETAILED DESCRIPTION

In the following detailed description of the preferred embodiments, reference is made to accompanying drawings, which form a part hereof, and within which are shown by way of illustration specific embodiments by which the invention may be practiced. It is to be understood that other embodiments may be utilized and structural changes may be made without departing from the scope of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention; the description taken with the drawings making apparent to those skilled in the art how the several forms of the present invention may be embodied in practice. Further, like reference numbers and designations in the various drawings indicate like elements.

Figure 1:
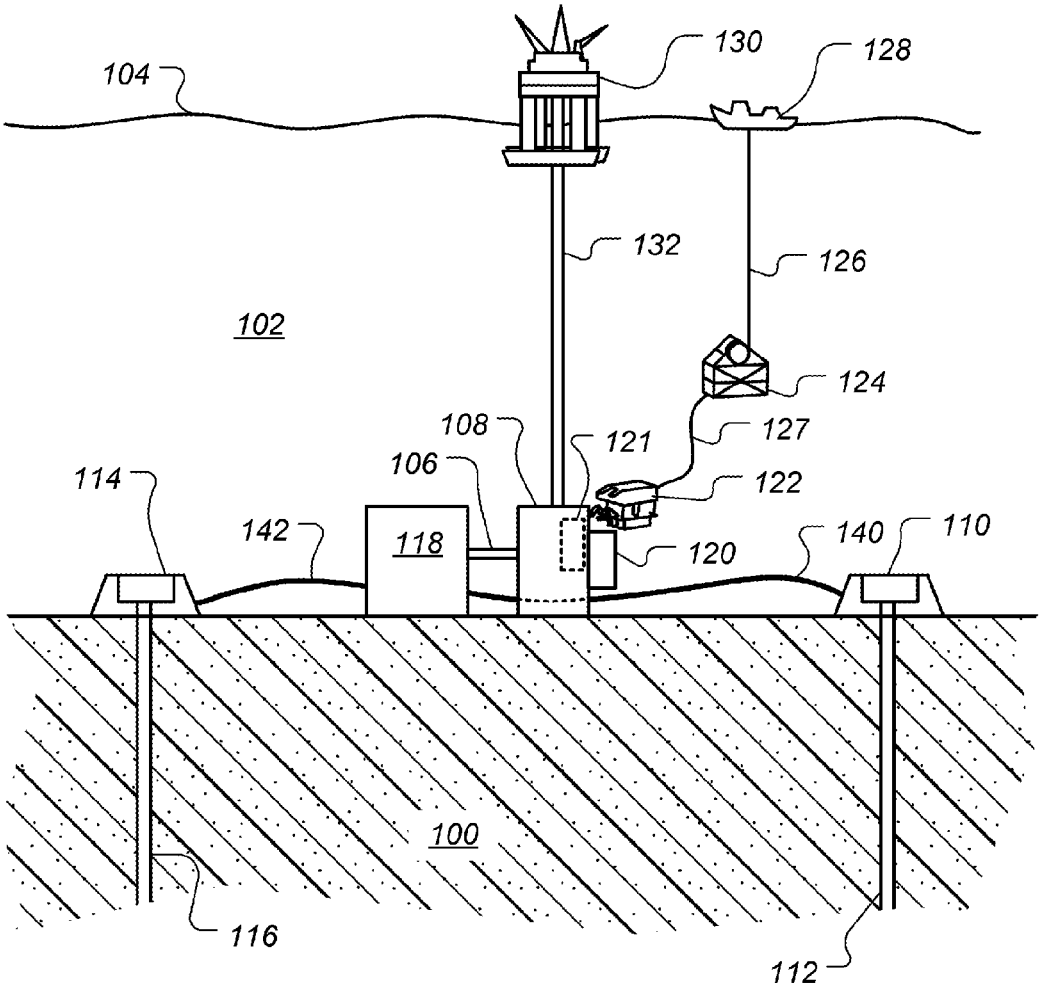
FIG. 1 is a schematic representation of a subsea location in which controlled pressure equalization can be carried out, according to some embodiments.
Figure 2:
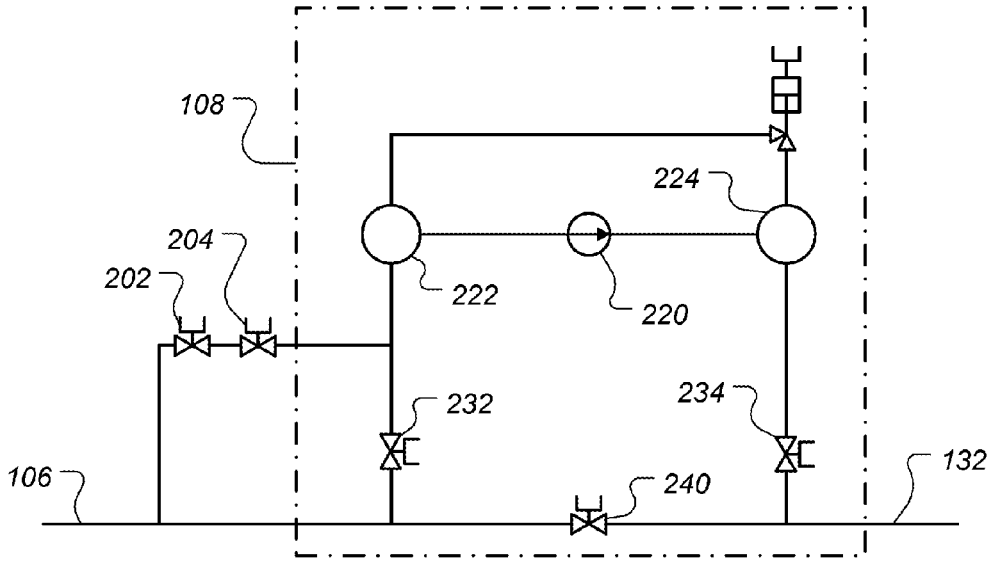
FIG. 2 (prior art)
FIG. 2 is a schematic diagram showing a typical known subsea station with a bypass header and isolation valves.

FIG. 1 is a schematic representation of a subsea location in which controlled pressure equalization can be carried out, according to some embodiments. Production manifold 118 serves as a hub for production well 112, having wellhead 110, and well 116, having wellhead 114. The wellheads 110 and 114 are connected to production manifold 118 via flow lines 140 and 142 respectively. It will be appreciated that although two wells are shown in the example of FIG. 1, embodiments described can operate with other numbers of production wells. At the production manifold 118, production fluids from the production wells are comingled before flowing via flow line 106 to a subsea station 108, which according to some examples is a subsea pumping station. After subsea station 108 the production fluids flow to a production facility, such as production platform 130 through flow line 132. According to some embodiments, a pressure equalization unit 121 is used to control pressure equalization between subsea station 108 and, for example, flow lines 106 and/or 132. The equalization unit 121 can be integrated into the subsea station 120, such as shown in FIG. 1. According to some embodiments, the ROV 122 operates the equalization unit 121. According to some other embodiments, instead of being integrated, an ROV-retrievable pressure equalization unit 120 can be used, as will be described in further detail herein. Although pressure equalization unit 120 is shown in FIG. 1 as mounted to station 108, according to some embodiments, unit 120 is configured as skid that is carried by ROV 122. Although one example of the application of equalization units 120 and 121 are with a subsea station 108 that is a subsea pump (e.g. either single phase, multiphase or hybrid), in general the pressure equalization units 120 and 121 can be used in any application, in any location, where pressure equalization between two fluid lines is desired. Examples of other types of subsea equipment with which the techniques disclosed herein may be applied to include, but are not limited to are: subsea compressors, subsea pressure testing equipment, subsea pumps, subsea separators, subsea hydrate removal, subsea hydrocarbon removal during intervention, and subsea water injection.

An ROV 122 is shown being deployed from a location on the surface 104 of sea 102, such as intervention vessel 128. ROV 122 is tethered using main lift umbilical 126 to tether management system 124, which manages the free-swimming tether 127 to ROV 122. The ROV 122 is used to control the pressure equalization units 120 and/or 121, for example by manipulating valves on the units 120, 121 and/or station 108. According to some embodiments, ROV 122 can also be used to deploy and/or retrieve unit 120 by positioning and connect/disconnecting unit 120 to/from station 108.

Figure 3:
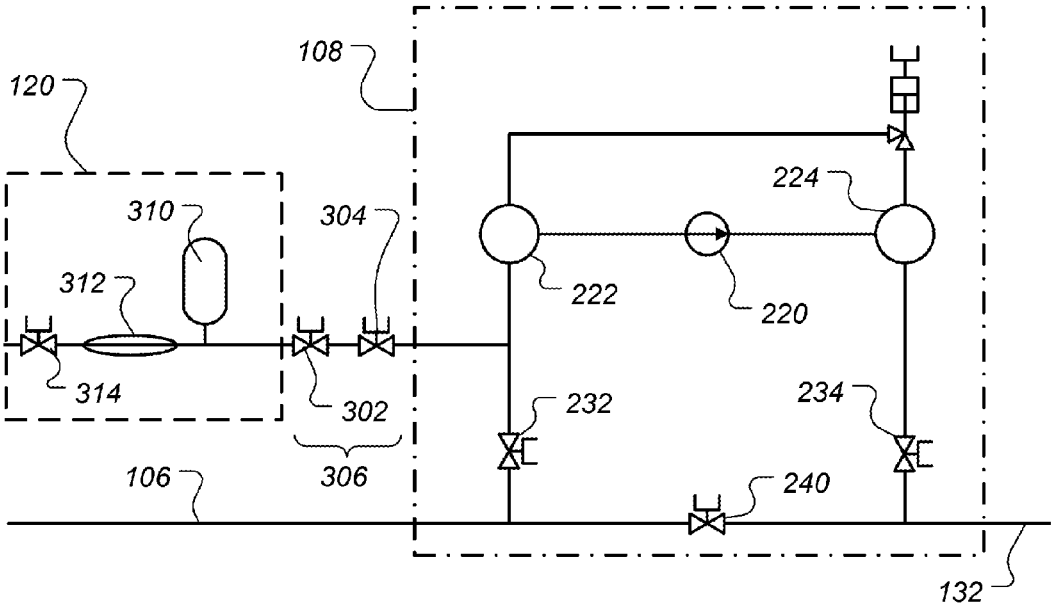
FIG. 3 is a schematic diagram illustrating aspects of a ROV-retrievable system for controllable pressure equalization, according to some embodiments.

FIG. 3 is a schematic diagram illustrating aspects of a ROV-retrievable system for controllable pressure equalization, according to some embodiments. As described, supra, subsea station 108 in the illustrated example is a subsea pumping station, but according to other embodiments, it could be any type of subsea equipment where controlled pressure equalization or change is desirable. In this case, pumping station 108 includes a bypass valve 240, suction valve 232, flow mixer 222, pump 220, flow mixer 224 and discharge valve 234. The controllable pressure equalization unit 120 which can be mountable onto station 108 or maybe configured as an ROV skid, as described, supra. According to some embodiments, equalization unit 120 is connected to station 108 via a hot stab 306 (high pressure sub-sea connector), which is designed to be ROV operated. The hot stab 306 includes valves 302 and 304. The equalization unit 120 in this example includes a piston accumulator 310 and a nozzle 312 and valve 314. According to some embodiments nozzle 312 is of design such as described in International Patent Application No. WO 2010/080037A1, which is incorporated by reference herein.

In one example, the equalization unit 120 is used to reduce fluid pressure in station 108 in a controlled manner, for example following a pressure test of station 108. In this example the hot stab valves 302 and 304 are opened the pressure in the accumulator 310 is increased to match the pressure in station 108. The bleed valve 314 is opened and the combination of the accumulator 310 and nozzle 312 allow for depressurization of station 108 in a controlled manner. Note that the bleed valve 314 can lead back to the flow line 106, to the topside or into the sea, depending on the type of fluid and environmental considerations. Thus, the pressure gradient during depressurization is predictable according to the properties of the accumulator 310 and nozzle 312, as well as by the pressure differential.

Figure 4:
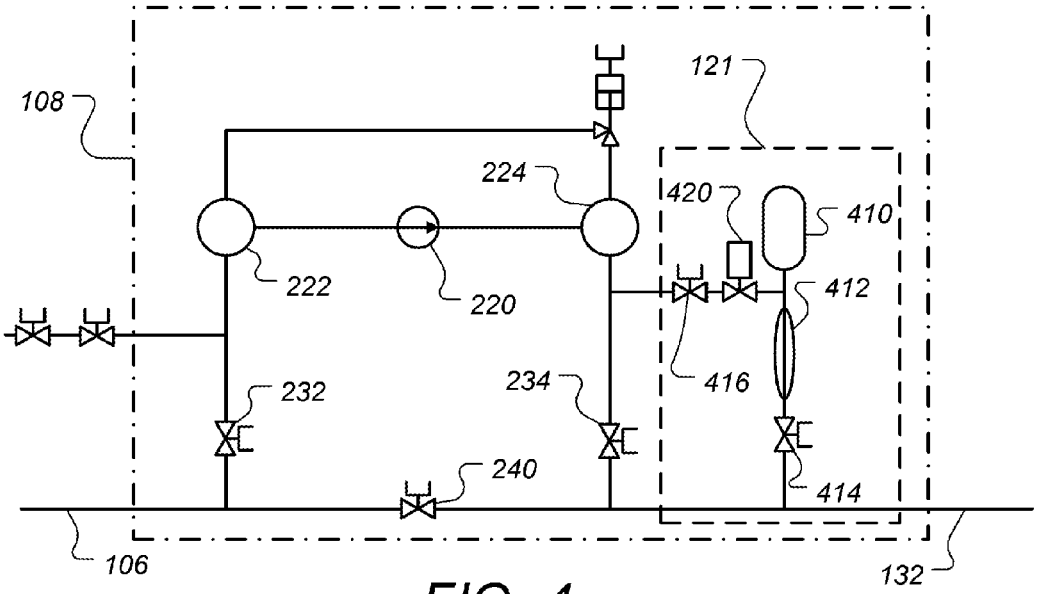
FIG. 4 is a schematic diagram illustrating aspects of a system for controllable pressure equalization integrated into a subsea station, according to some embodiments.

FIG. 4 is a schematic diagram illustrating aspects of a system for controllable pressure equalization integrated into a subsea station, according to some embodiments. In this example, the pressure equalization unit 121 is permanently integrated into subsea station 108. Equalization unit 121 is shown mounted on the discharge side of pump 220, and includes an accumulator 410, nozzle 412 and valves 414 and 416. As in the case of nozzle 312 of FIG. 3, according to some embodiments, nozzle 412 is of design such as described in International Patent Application No. WO 2010/080037A1. Note that according to some embodiments, the equalization unit 121 is mounted on the suction side of pump 220 instead of, or in addition to, the discharge side of pump 220. For example the valve 416 could be connected between flow mixer 222 and valve 232. According to some embodiments MeOH system 420 (or a similar system) is used for both pressurizing the system in connection with a pressure test, while at the same time charging the accumulator 410 that will be used in connection with the pressure equalization, as described. According to some embodiments, using MeOH or similar fluids when charging the accumulator ensures that MeOH is mixed with the process fluids during pressure equalization. This has the added benefit of minimizing the risk of hydrate formation as well as reduce the risk of blockage of the nozzle 412 by particles or debris. This benefit of using MeOH or similar fluid is also applicable to other embodiments described herein, such as, for example, with respect to FIG. 6, described infra.

Figure 5:
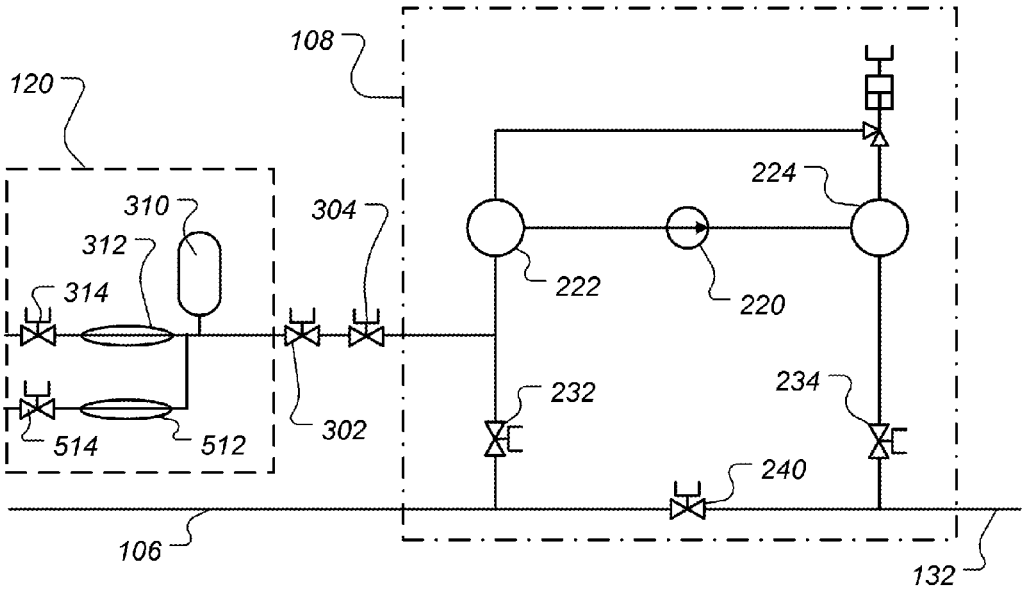
FIG. 5 is a schematic diagram illustrating aspects of a system for controllable pressure equalization, according to some embodiments.

FIG. 5 is a schematic diagram illustrating aspects of a system for controllable pressure equalization, according to some embodiments. In the example of FIG. 5, the pressure equalization unit 120 includes two nozzles 312 and 512 mounted in parallel. According to some embodiments nozzles 312 and 512 are of a design such as described in International Patent Application No. WO 2010/080037A1. By providing more than one nozzle in parallel, the depressurization (or pressurization) rate can be selected and/or altered depending on what is desired for the application at hand by selectively opening or closing valves 314 and/or 514. According to some embodiments, more than two nozzles are mounted in parallel, such as 3 or 4 nozzles. According to some embodiments the nozzles are of different channel diameters and/or of different lengths, which allows for further control over the equalization process. According to some embodiments, particles can be handled by selecting a suitable nozzle channel diameter. Particles can further be handled by locating the branching out point from the process pipe, for instance, on top of the pipe to avoid particle transportation into the unit 120.

Figure 6:
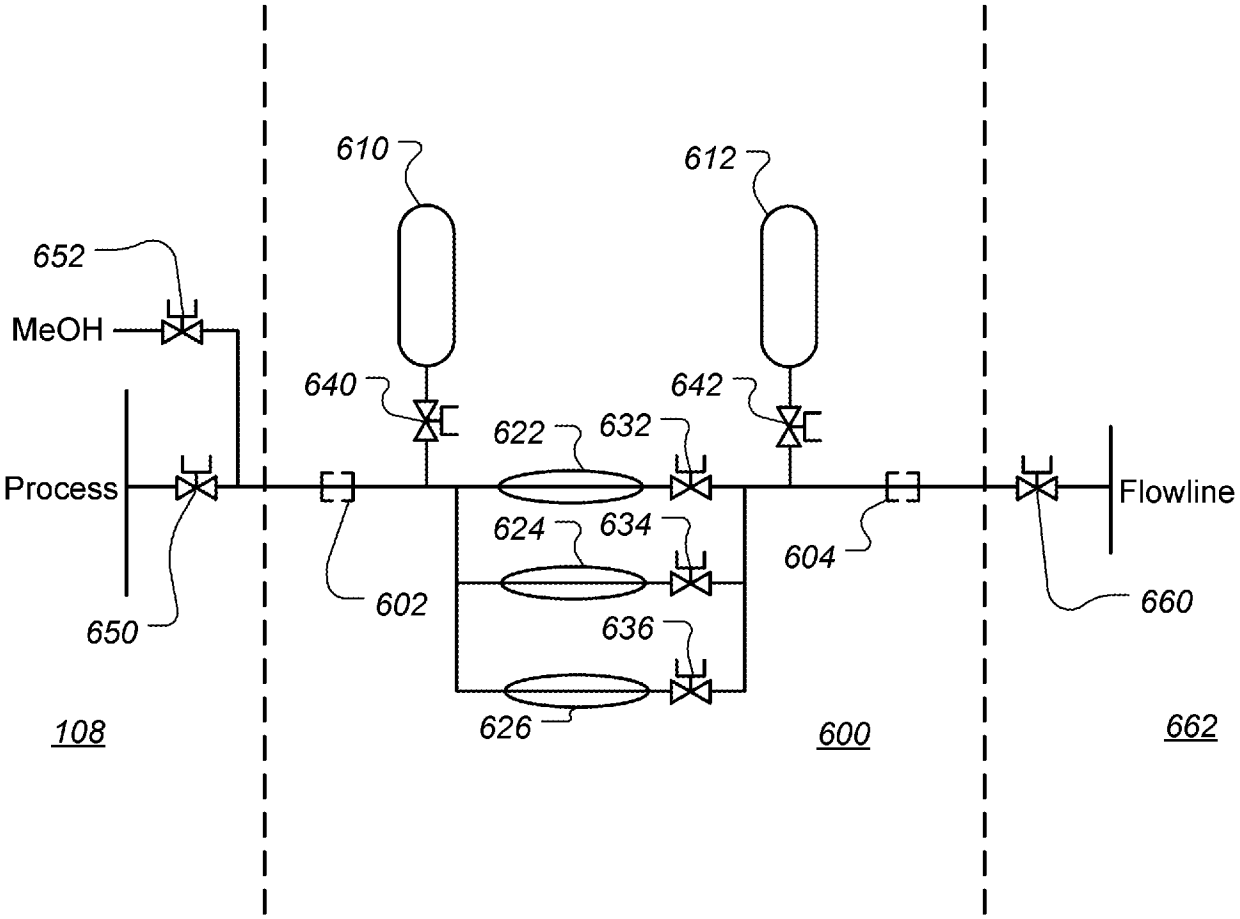
FIG. 6 is a schematic diagram illustrating aspects of a system for controllable pressure equalization, according to some further embodiments.

FIG. 6 is a schematic diagram illustrating aspects of a system for controllable pressure equalization, according to some further embodiments. In this case shown in FIG. 6, controllable pressure equalization unit 600 can be either ROV deployable and retrievable, such as with unit 120, or it can be permanently mounted within a subsea station, such as with unit 121, both described supra. In the case where equalization unit 600 is retrievable, it includes breakable connections 602 and 604. Unit 600 includes two accumulators 610 and 612 that can be selectively isolated using valves 640 and 642 respectively. Positioned between the accumulators are three nozzles, 622, 624 and 626, that can be selectively included in the flow path using valves 632, 634 and 636, respectively. As in the case of other nozzles described herein, according to some embodiments nozzles 622, 624 and 626 are of a design such as described in International Patent Application No. WO 2010/080037A1.

According to some embodiments, the operation of the equalization unit 600 will be described in the context of several exemplary cases. In a first example case, a high pressure exists in the subsea station 108 following a procedure such as a pressure test of the station 108. Valves 650 and 652 are closed on both sides equalization unit 600 (which can be either permanent or retrievable). Using fluid supply valve 652, the MeOH supply system (or other fluid supply systems) can be used to pressurize the accumulator 610 (by opening valve 640 and closing valve 642) to a desired pressure. Valve 650 is then opened in order to take the initial pressure drop in the station 108. The pressure in the station 108 decreases as the pressure in accumulator 610 increases. One or more of the valves 632, 634 and 636 are opened which select which one or more of the nozzles 622, 624 and 626 are to be used. Valve 660 is then opened. The pressure in the station 108 is then gradually decreased towards pressure in flow line 662. The capacity of accumulator 610 and properties of one or more of the nozzle being used will determine the pressure drop gradient. Preferably, the pressure drop gradient is selected so as to be suitable for the station 108. For example, in the case where station 108 is a subsea pump, the nozzles are selected so as to match the response time for the barrier fluid system of the pump (not shown in FIG. 6) of station 108. Note that flow line 662 can correspond, for example, to a flow line from one or more wells (such as lines 140, 142 or 106 in FIG. 1) or to a flow line to a top side facility (such as line 132 in FIG. 1). In many cases a MeOH injection point (or similar) is available on the station side. According to some embodiments, the MeOH (or other fluid) supply is used to equalize the pressure. For pressurization liquid MeOH or other liquid can be used. In the case of de-pressurization, an accumulator, or simply gas trapped in the system acting as an accumulator due to expansion, can be used. Thus according to some embodiments, if there is an adequate supply of gas on the higher pressure side, then it can be used for pressure equalization instead of the accumulator.

In a second illustrating case, the flow line 662 initially has a higher pressure compared to station 108. In this case, accumulator 612 is used (by opening valve 642 and closing valve 640) in combination with one or more of the nozzles 622, 624 and 626 (by opening or closing valves 632, 634 and 636) to avoid an overly abrupt pressure increase inside the station 108. Thereby avoiding undesirable effects, such as shifting the pump shaft or exceeding the maximum rate of pressure change for the pump barrier system.

In general, the system 600 can be used for all cases where a smooth pressure transition is desired between a high pressure and a low pressure section. Installing isolation valves on the accumulators allows (such as valves 640 and 642) the unit 600 to be used for equalization where the higher pressure is on either side of the unit 600. Furthermore, by using several nozzles in parallel (such as nozzles 622, 624 and 626), increased versatility (by accommodating various pressure differentials and pressure gradients) increase system robustness (by providing redundant nozzles and higher tolerance for particulate matter) is provided.

Thus the described techniques, according to some embodiments, solves problems associated with the prior art technique of repeatedly opening and closing two valves separated by a small volume, including: (1) the problem with the number of valve operations; and (2) abrupt and/or unpredictable pressure changes.

Figure 7:
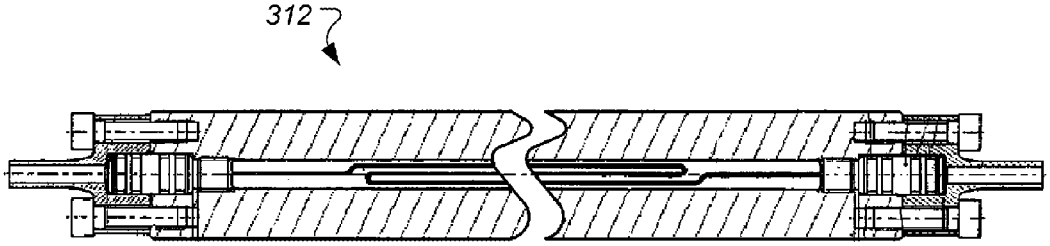
FIG. 7 is a cross-section of a nozzle configured for providing controllable pressure reduction between two fluid conducting pipes, according to some embodiments.

FIG. 7 is a cross-section of a nozzle configured for providing controllable pressure reduction between two fluid conducting pipes, according to some embodiments. The nozzle is shown as nozzle 312, but the same or similar designs can be used for nozzles 412, 512, 622, 624 and 626 described herein. For further details of nozzle 312 please refer to International Patent Application No. WO 2010/080037A1.

Figure 8:
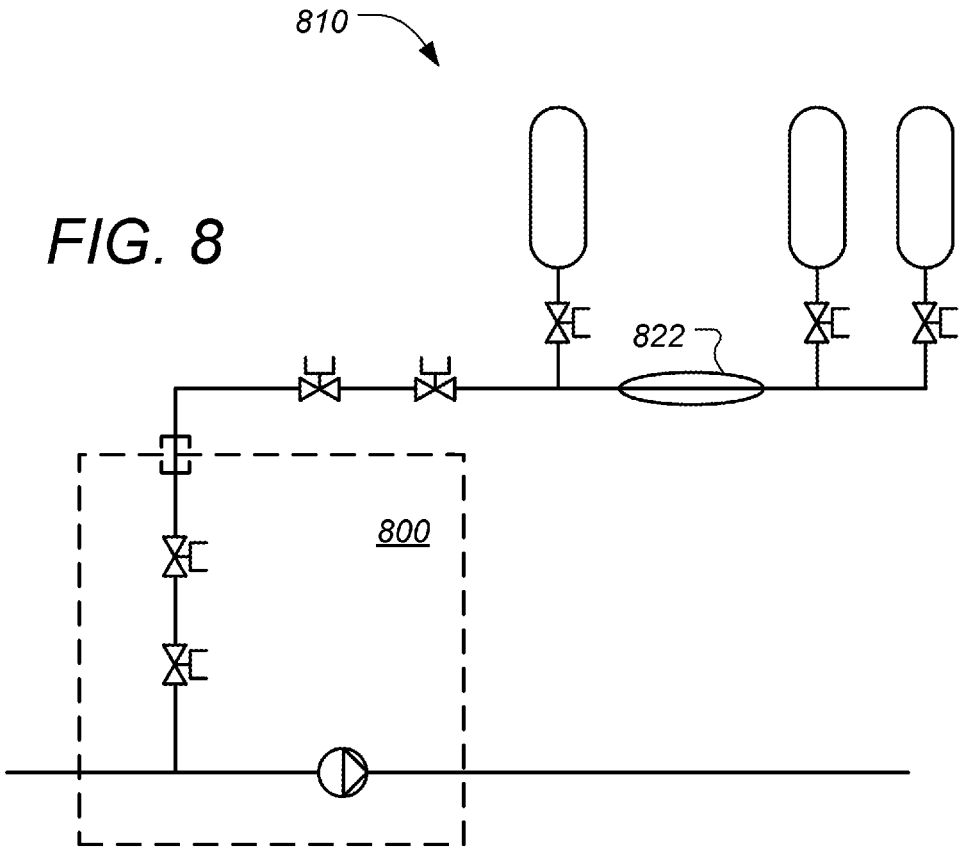
FIGS. 8 and 9 are schematic diagrams illustrating further aspects of a system for controllable pressure equalization, according to some further embodiments.
Figure 9:
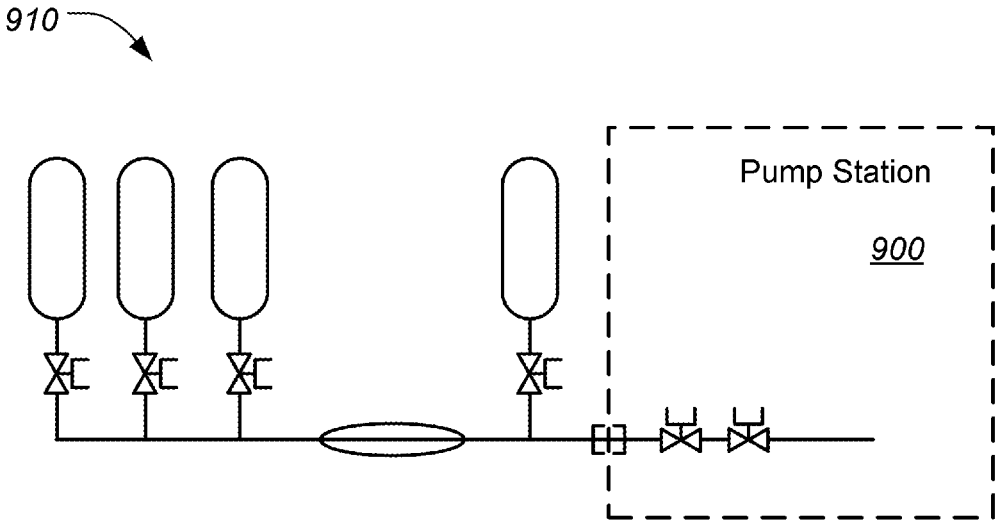

FIGS. 8 and 9 are schematic diagrams illustrating further aspects of a system for controllable pressure equalization, according to some further embodiments. FIG. 8 shows an installation tool 800 with added functionality 810 for changing or equalizing pressure while performing a subsea installation procedure. FIG. 9 shows a pump station 900 and functionality 910 that is used for decompression for example for purposes of hydrate melting and removal. According to some embodiments, hydrocarbon can be removed via ROV to the topside. For further details of techniques for melting and removal of hydrates from deep sea flow lines, see co-pending patent application GB 2503927, which is incorporated herein by reference. Note that if the accumulator(s) are pressurized together with the station (e.g. using MeOH), the accumulator will be pre-charged with MeOH (or other fluid, e.g. MEG). The fluid moving through the nozzle during depressurization will then automatically be mixed with the MeOH. Hydrates will hence be prevented from freezing within the nozzle. As mentioned above, if an adequate supply of gas (e.g. MeOH in the case of hydrate removal) the use of an accumulator can be avoided in some cases. The setups shown FIGS. 8 and 9 can be easily hooked up to various hot stabs if combining with the running tool and jumpers. According to some embodiments, the setups shown in FIGS. 8 and 9 can be used for reducing pressure differentials across large valves before opening.

Whereas many alterations and modifications of the present invention will no doubt become apparent to a person of ordinary skill in the art after having read the foregoing description, it is to be understood that the particular embodiments shown and described by way of illustration are in no way intended to be considered limiting. For example, although many embodiments have been described herein in the context of various types of subsea applications, the techniques described herein are also applicable beyond the subsea environment. Examples of surface applications for the pressure equalization techniques described herein include refining and chemical processing, but in general the techniques described herein can be applied to any surface setting where pressure change and/or equalization is desirable.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A method of controllably decreasing a pressure difference between a higher pressure volume and a lower pressure volume, the method comprising:

opening a first valve thereby allowing fluid communication along a fluid flow line between said higher pressure volume and an accumulator such that pressure in said accumulator matches the pressure in said higher pressure volume; and after said pressure matching, opening a second valve thereby allowing fluid communication along said fluid flow line between said lower pressure volume, a flow restricting nozzle and said accumulator, the combination of said accumulator and said nozzle providing a transition between the pressures of said higher and lower pressure volume.

2. The method according to claim 1 wherein said higher pressure volume is a higher pressure fluid conducting pipe, said lower pressure volume is a lower pressure fluid conducting pipe, and said opening of the second valve lasts until pressure between the higher pressure and lower pressure conducting pipes is equalized.

3. The method according to claim 2 wherein said higher and lower pressure fluid conducting pipes, said first and second valves, said accumulator and said nozzle are located in a subsea environment.

4. The method according to claim 2 wherein one of the higher and lower pressure fluid conducting pipes forms part of a subsea processing station and the other one of the higher and lower pressure fluid conducting pipes is a subsea flow line.

5. The method according to claim 4 wherein the subsea processing station is selected from a group consisting of: multiphase subsea pump; single-phase subsea pump; hybrid subsea pump; subsea multiphase compressor; subsea multiphase meter; subsea multiphase measurement system; subsea sampling system; subsea separation system; subsea hydrate removal system; subsea hydrocarbon removal system; and subsea water injection system.

6. The method according to claim 4 wherein the higher pressure fluid conducting pipe forms part of the subsea processing station and the lower pressure fluid conducting pipe is the subsea flow line.

7. The method according to claim 6 wherein said opening of the first valve takes place following a high pressure procedure in said subsea processing station.

8. The method according to claim 4 wherein the higher pressure fluid conducting pipe is the subsea flow line and the lower pressure fluid conducting pipe forms part of the subsea processing station.

9. The method according to claim 2 further comprising prior to opening said first valve, operating one or more accumulator selection valves in order to provide fluid communication of said accumulator with said fluid flow line and to isolate a second accumulator from said fluid flow line.

10. The method according to claim 2 wherein one or more other flow restricting nozzles are positioned in parallel with said flow restricting nozzle, and said method further comprises, prior to opening said second valve, operating one or more nozzle selection valves so as to select which of said flow restricting nozzles will be used in equalizing the pressure.

11. The method according to claim 10 wherein said selecting is made so as to attain a desired pressure equalization.

12. The method according to claim 10 wherein said selecting is made so as to reduce effects due to particulate clogging of nozzles.

13. The method according to claim 2 further comprising, prior to said opening of said first valve, pre-charging said accumulator using a source fluid.

14. The method according to claim 2 further comprising, after said opening of said second valve, retrieving a carrier including at least the accumulator and the flow restricting nozzle using a remotely operated underwater vehicle.

15. The method according to claim 2 wherein a capacity of said accumulator and frictional loss characteristics of said nozzle are selected to provide a desired smoothness in pressure change during operation.

* * * * *